US007867040B2

(12) United States Patent
Yu et al.

(10) Patent No.: US 7,867,040 B2
(45) Date of Patent: Jan. 11, 2011

(54) CABLE ASSEMBLY WITH RETAINER FOR HOLDING CONNECTOR

(75) Inventors: Ya-Fei Yu, Shenzhen (CN); Xian-Kui Shi, Shenzhen (CN); Chung-Yen Yang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/535,379

(22) Filed: Aug. 4, 2009

(65) Prior Publication Data

US 2010/0029138 A1 Feb. 4, 2010

(51) Int. Cl.
*H01R 13/502* (2006.01)

(52) U.S. Cl. ..... 439/701; 439/731

(58) Field of Classification Search ..... 439/660, 439/607.23–607.26, 717, 540.1, 541.5, 701, 439/731

See application file for complete search history.

(56) References Cited

U.S. PATENT DOCUMENTS 5,362,261 A * 11/1994 Puerner ..... 439/752
6,193,554 B1 * 2/2001 Wu ..... 439/607.25
6,234,834 B1 * 5/2001 Tsai et al. ..... 439/541.5
6,699,074 B1 * 3/2004 Wu et al. ..... 439/607.08
7,315,444 B2 1/2008 Chen et al.
7,641,514 B2 * 1/2010 Chen et al. ..... 439/540.1
2009/0253304 A1 * 10/2009 Chen et al. ..... 439/628
2009/0269977 A1 * 10/2009 Chen et al. ..... 439/540.1
2009/0311909 A1 * 12/2009 Yu et al. ..... 439/607.23
2010/0068922 A1 * 3/2010 Zhou et al. ..... 439/527
2010/0075544 A1 * 3/2010 Liu et al. ..... 439/701
2010/0093219 A1 * 4/2010 Liu et al. ..... 439/607.58
2010/0206702 A1 * 8/2010 Zhou et al. ..... 200/51.02

* cited by examiner

*Primary Examiner*—Neil Abrams
*Assistant Examiner*—Phuong Nguyen
(74) *Attorney, Agent, or Firm*—Wei Te Chung; Andrew C. Cheng; Ming Chieh Chang

(57) ABSTRACT

A cable assembly comprises an insulative housing defining a first receiving room extending rearwardly from a front surface of the insulative housing. A first electrical connector is received into the first receiving room. A first cable is electrically connected with the first electrical connector and extends rearwardly out of the insulative housing. And a retainer is received into the first receiving room and engaged with the insulative housing, the first electrical connector is held by the retainer.

20 Claims, 7 Drawing Sheets

CABLE ASSEMBLY WITH RETAINER FOR HOLDING CONNECTOR

FIELD OF THE INVENTION

The present invention relates to cable assembly, particularly to a cable assembly with a retainer for holding a connector therein and together received into an insulative housing of the cable assembly.

DESCRIPTION OF PRIOR ART

Along with the miniaturization and multi-functional development trend of electronic apparatus, the requirements for electrical connectors are on a rapid increase. The electrical connectors are required to not only have an excellent performance of signal transmission, but also have the structure of compact size, simplicity and user-friendly features. Recently, Universal Serial Bus (USB) and audio jack both become a popular connection interface. The USB and audio jack are designed to provide input/output (I/O) ports of an electronic apparatus. With the trend toward miniaturization in electrical apparatus, a variety of compositive connector assemblies integrating a plurality of electrical connectors have been developed.

U.S. Pat. No. 6,193,554 to Wu on Feb. 21, 2001 disclose a stacked USB connector assembly adapted to be mounted on a mother board at an I/O port of an electronic apparatus for mating with complementary USB connectors of a peripheral equipment, i.e. a keyset, a mouse, a Personal Digital Assistant (PDA), or a Digital Camera. U.S. Pat. No. 6,234,834 issued to Tsai on May 22, 2001 further discloses a stacked audio jack connector assembly adapted to be mounted on a mother board at an I/O port of an electronic apparatus for mating with complementary audio plug of a speaker or a computer to provide an audio transmission therebetween. In addition, U.S. Pat. No. 6,699,074 issued to Wu on Mar. 2, 2004 discloses a cable assembly with two USB connectors and two audio jacks arranged side by side on a mother board and serving as an I/O port of an electronic apparatus for mating with complementary USB connectors or audio plugs of a peripheral equipment.

Please refer to FIG. 6 and FIG. 7 of a prior art, cable assembly 200 defines two stacked USB connectors 201 fully received into a first receiving room 222 formed by an upper cover 211 and a lower cover 212. However, at sometimes, only one USB connector 201 needs to be assembled in the insulative housing of the cable assembly 200 due to the demand for computer configuration. As the number of the connectors received into the insulative housing are decreased, so the first receiving room 222 will not be fully filled with the connectors. Thus, the connectors will not be tightly positioned in the insulative housing of the cable assembly 200. In this way, a new insulative housing should be developed for receiving a proper number of the connectors which can be tightly positioned in the insulative housing. However, developing a new insulative housing needs more production cost, and the original mold for forming the original housing will not be utilized sufficient.

As discussed above, an improved cable assembly overcoming the shortages of existing technology is needed.

SUMMARY OF THE INVENTION

Accordingly, an object of the present invention is to provide a retainer for holding a connector therein and together tightly positioned in the insulative housing of the cable assembly.

In order to achieve the above-mentioned objects, a cable assembly comprises an insulative housing defining a first receiving room extending rearwardly from a front surface of the insulative housing. A first electrical connector is received into the first receiving room. A first cable is electrically connected with the first electrical connector and extends rearwardly out of the insulative housing. And a retainer is received into the first receiving room and engaged with the insulative housing, the first electrical connector is held by the retainer.

Other objects, features and advantages of the invention will be apparent from the following detailed description taken in connection with the accompanying drawings.

DETAILED DESCRIPTION OF PREFERRED EMBODIMENTS

Figure 1:
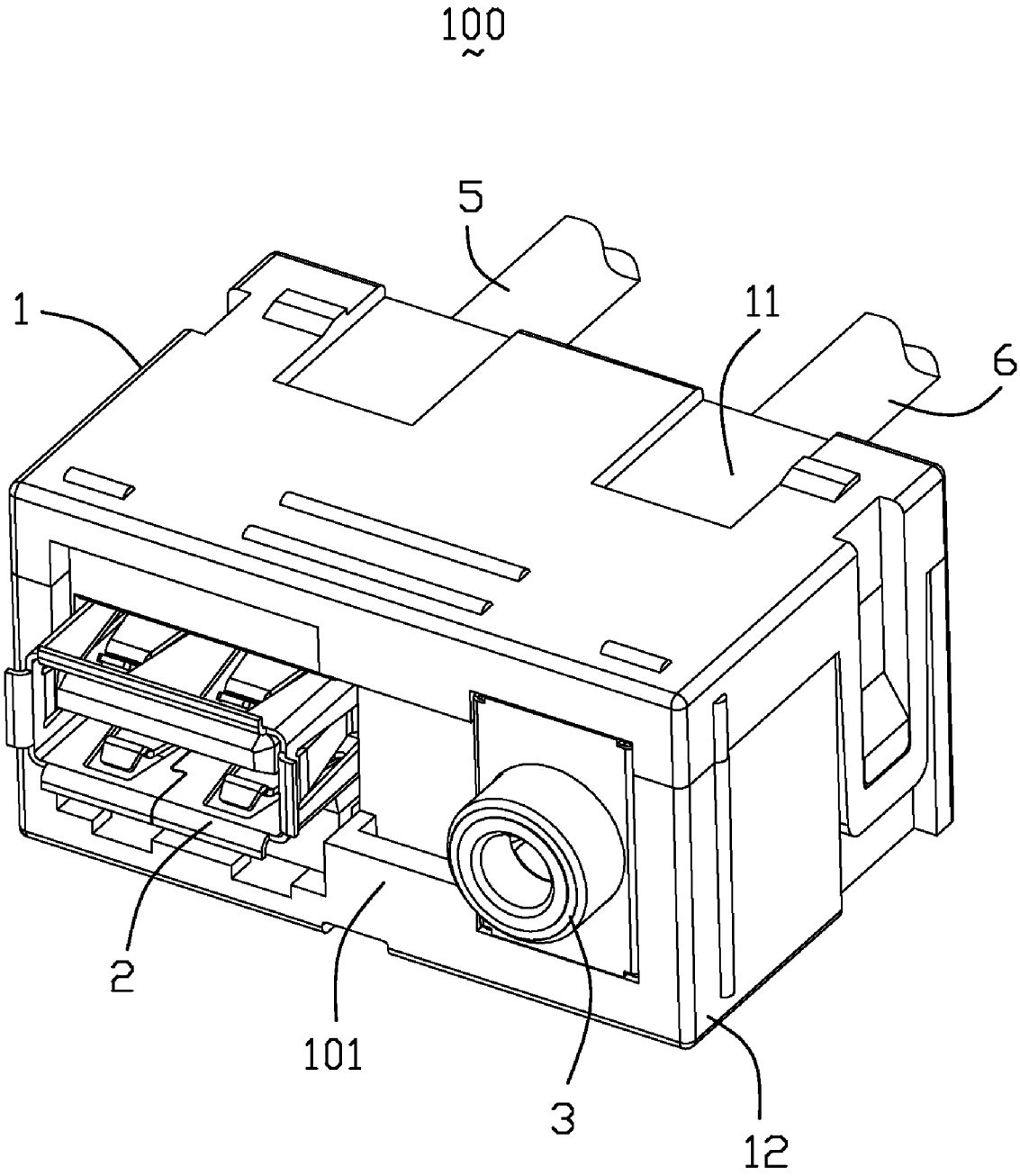
FIG. 1 is a perspective view of a cable assembly in accordance with the present invention.

Reference will now be made to the drawing figures to describe the present invention in detail.

Figure 5:
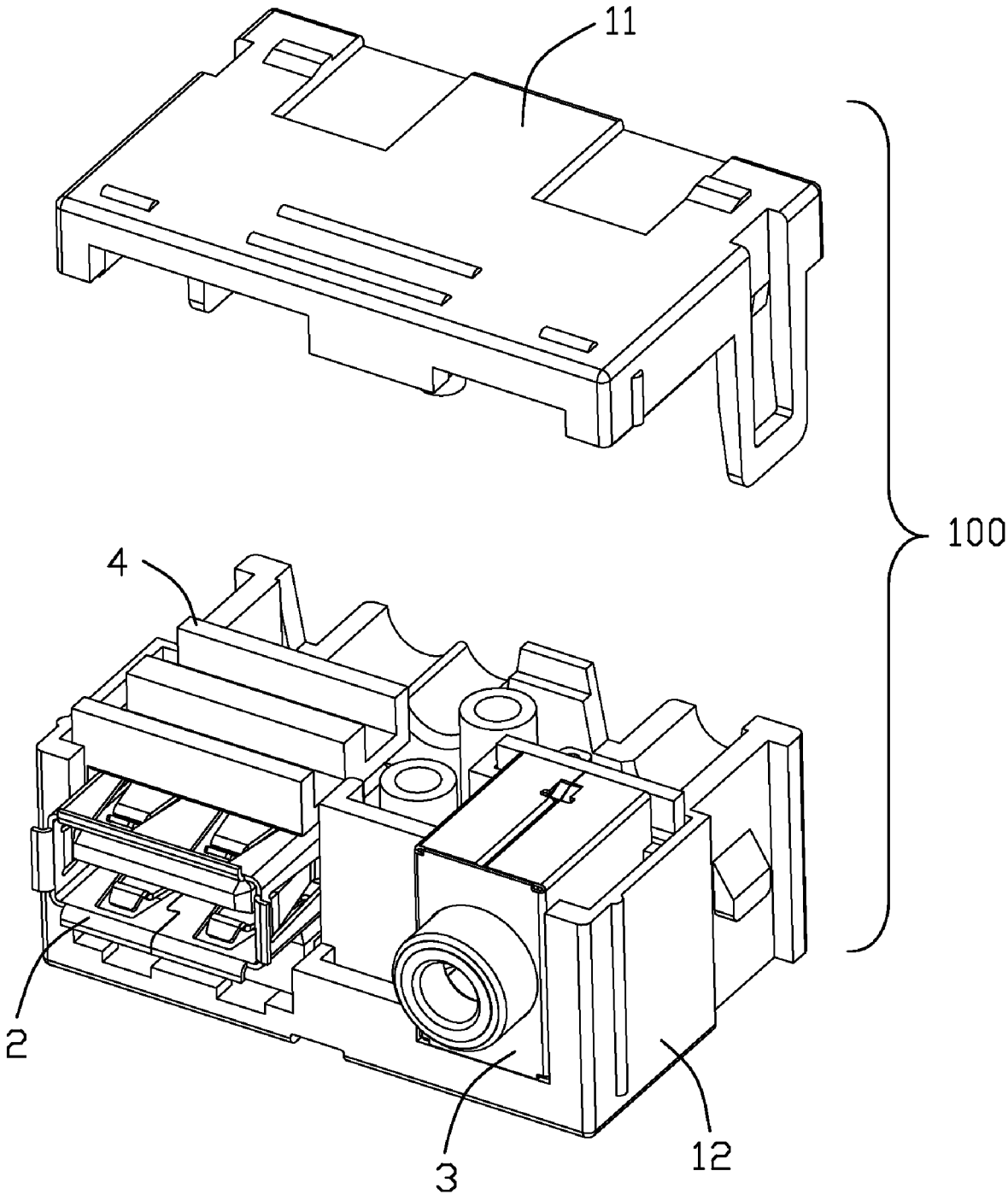
FIG. 5 is a partial assembled, perspective view of the cable assembly of FIG. 4.
Figure 6:
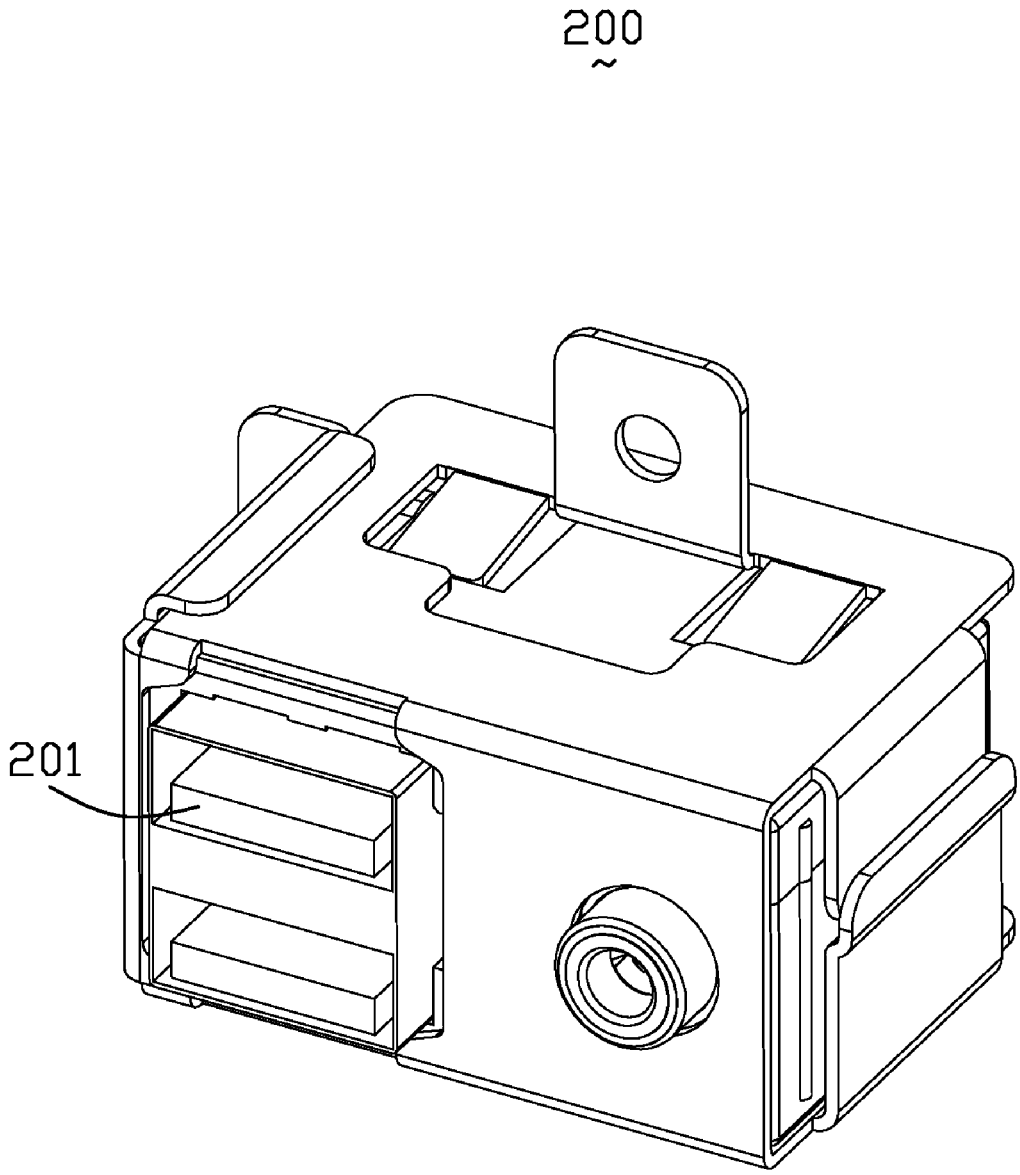
FIG. 6 (PRIOR ART)
FIG. 6 is a perspective view of a prior art cable assembly.
Figure 7:
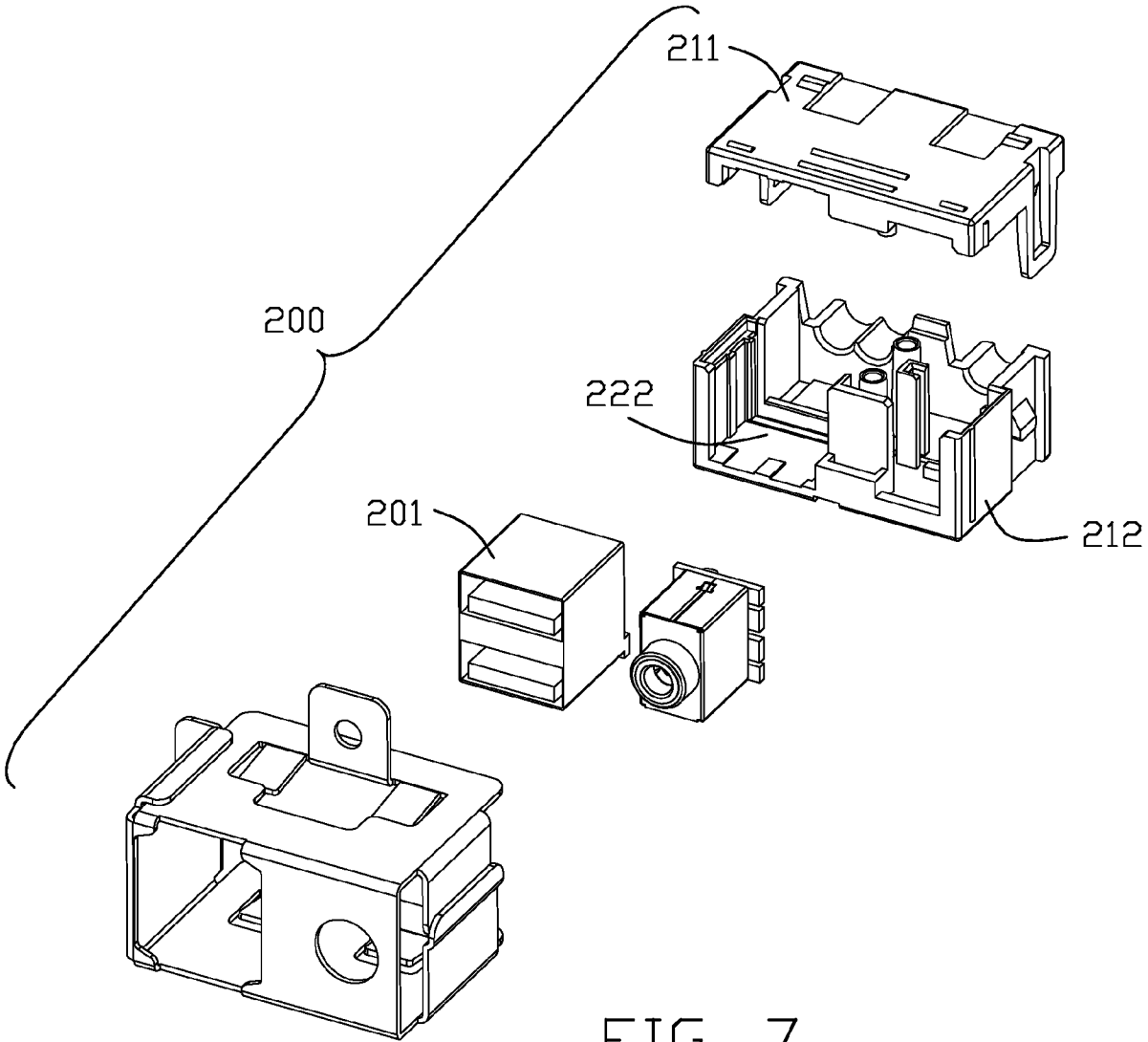
FIG. 7 (PRIOR ART)
FIG. 7 is an exploded perspective view of the prior art cable assembly of FIG. 6.

Referring to FIGS. 1 and 5, a cable assembly in accordance with the present invention, generally designated 100, is adapted for mating with a plurality of complementary connectors (not shown). The cable assembly 100 includes an insulative housing 1 and a first and second electrical connectors 2, 3 received into the insulative housing 1. A retainer 4 is disposed in the insulative housing 1 and surrounds the first connector 2. A first cable 5 is electrically connected with the first connector 2. A second cable 6 is electrically connected with the second connector 3. A metallic shell (not shown) encloses the insulative housing 1.

The insulative housing 1 is formed by an upper cover 11 and a lower cover 12. The insulative housing 1 defines a first receiving room 13 and a second receiving room 14 therein for respectively receiving the first and second connectors 2, 3. The first and second receiving rooms 13, 14 are arranged side by side in a transversal direction of the insulative housing 1. The insulative housing 1 defines a first and second openings 15, 16 on a front surface thereof and respectively communicated with the first and second receiving rooms 13, 14. A first and second cable outlets 17, 18 are formed on a rear surface of the insulative housing 1 and respectively communicated with the first and second receiving rooms 13, 14. A rib 131 extending in a vertical direction is formed on an inner surface of the first receiving room 13 of the insulative housing 1.

Figure 2:
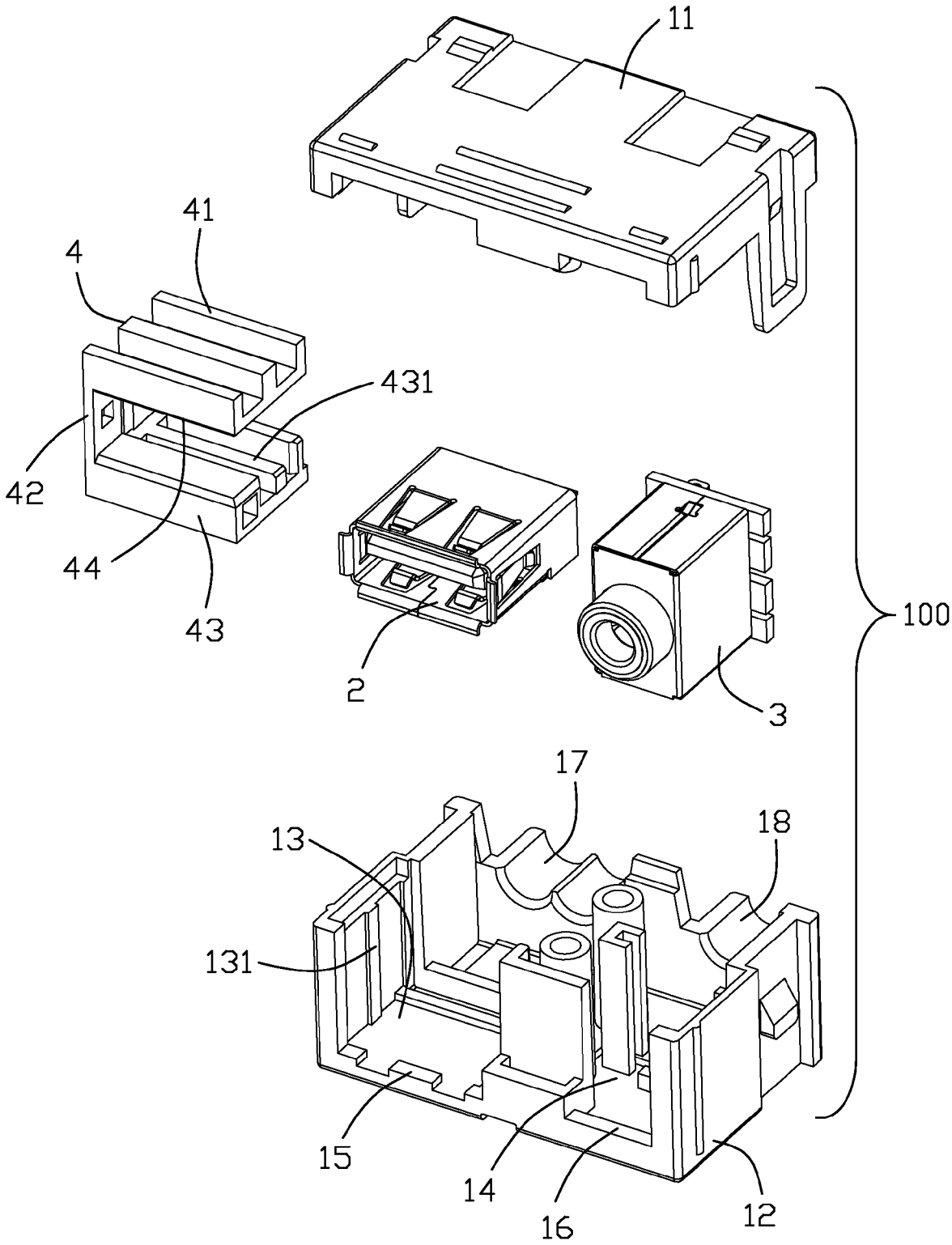
FIG. 2 is an exploded, perspective view of the cable assembly of FIG. 1.
Figure 3:
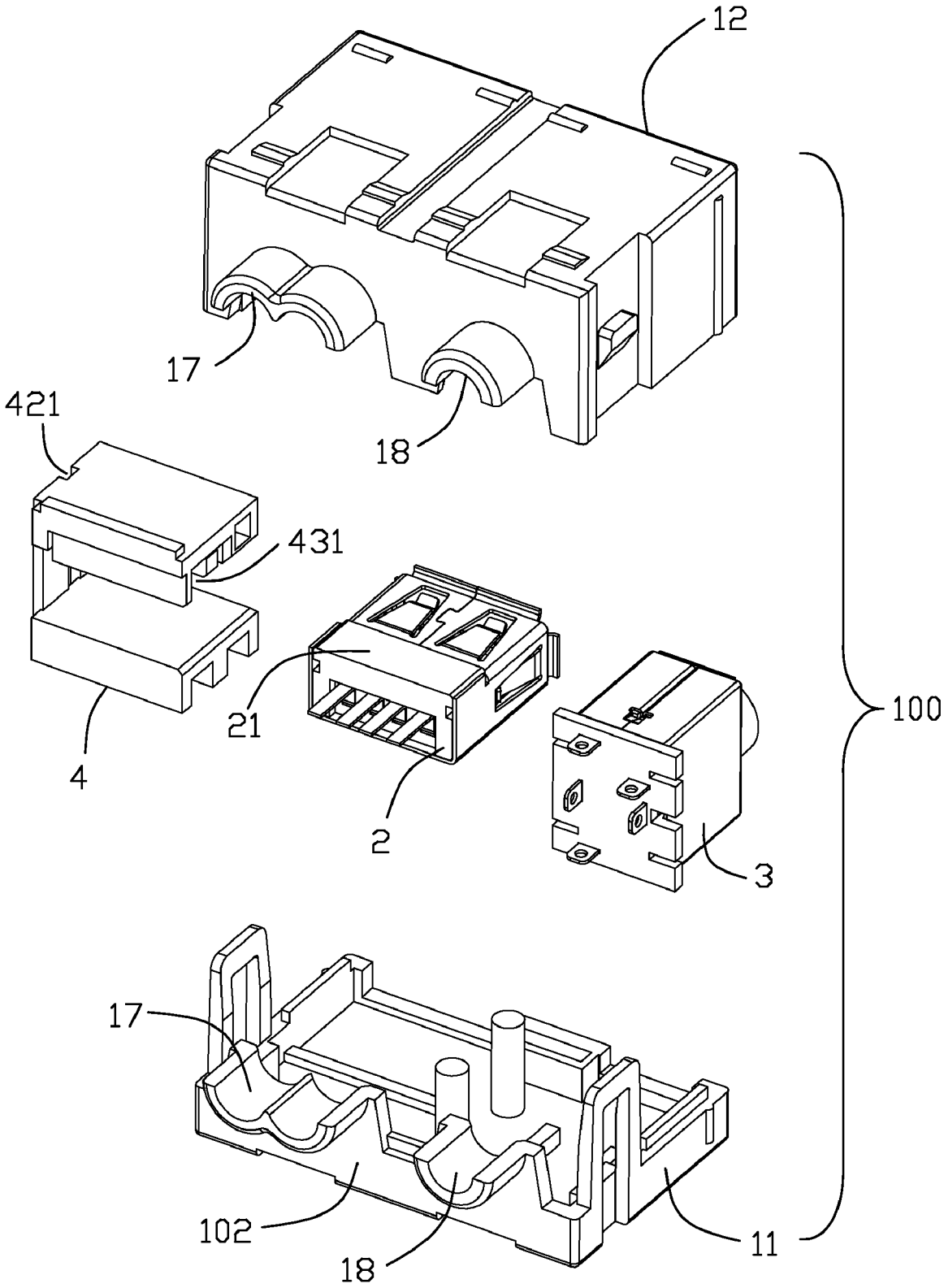
FIG. 3 is similar to FIG. 2, but viewed from another aspect.
Figure 4:
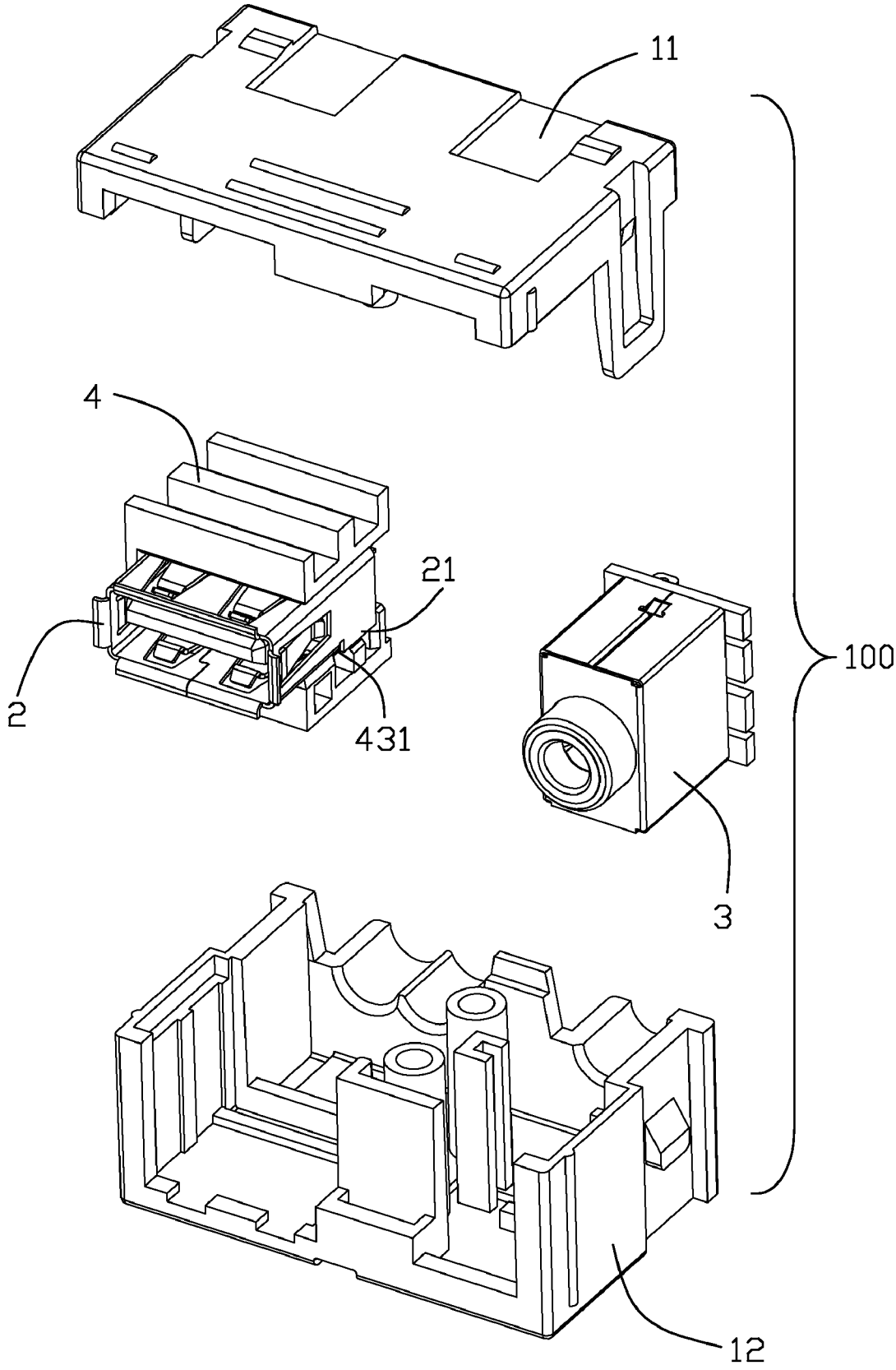
FIG. 4 is a partial assembled, perspective view of the cable assembly of FIG. 2.

Please referring to FIG. 2, the first electrical connector 2 is a typical USB connectors received in the first receiving room 13 of the insulative housing 1. The first electrical connector 2 has a same structure as an ordinary usb connector and the detailed description thereof is omitted here. A platform portion 21 is formed on an outer surface of the first electrical connector 2.

The second electrical connector 30 is an audio jack connectors and received into the second receiving room 14. The second electrical connector 30 has a same structure as an ordinary audio jack connector and the detailed description thereof is omitted here. The second electrical connector 30 has a mating port at a front end thereof and exposed to the second opening 16 of the second receiving room 14. The second cable 6 is electrically connected with the second electrical connector 3 and extends out of the insulative housing 1 though the second cable outlet 18.

Referring to FIGS. 2 to 5, the retainer 4 is generally U-shape, it comprises a top wall 41, a bottom wall 43 opposite to the top wall 41 and a side wall 42 connected with the top wall 41 and the bottom wall 43. A receiving slot 44 is defined by the top wall 41, the bottom wall 43 and the side wall 42. The first connector 2 can be fitly received into the receiving slot 44 of the retainer 4. The retainer 4 further defines a slot 421 on an outer surface of the side wall 42 for receiving the rib 131 formed in the first receiving room 13. A recess 431 is formed on a top surface of the bottom wall 43 of the retainer 4. The platform portion 21 of the first connector 2 can be received into the recess 431 to prevent the movement of the first connector 2 in a mating direction. A connector module is formed when the first connector 2 is assembled with the retainer 4. The height of the connector module is the same with the height of the first receiving room 13 of the insulative housing 1, so the first connector 2 can be received into the receiving room 13 properly. And the mating port of the first connector 2 can be exposed to the first opening 15 of the first receiving room 13.

Referring to FIGS. 1 and 5, in assembling, firstly terminating the first electrical connector 2 and the second electrical connector 3 to the first cable 5 and the second cable 6. Then, assembling the first electrical connector 2 to the retainer 4 to form a connector module, thus, the first electrical connector 2 is received into the receiving slot 44 of the retainer 4. Then, assembling the first electrical connector 2 and the retainer 4 together to the first receiving room 13 of the lower cover 12 of the insulative housing 1, the slot 421 of the side wall 42 is fitting to the rib 131 formed in the first receiving room 13 of the lower cover 12. Then, assembling the second electrical connector 3 to the second receiving room 14 of the lower cover 12 of the insulative housing 1. The first cable 5 extends rearwardly out of the cable outlet 17 of the lower cover 11. And, the second cable 6 extends rearwardly out of the cable outlet 18 of the lower cover 11. Then, assembling the upper cover 11 to the lower cover 12 in a up-to-down direction, thus, the first and second electrical connectors 2, 3 are positioned in the insulative housing 1. At last, assembling the metallic shell to the insulative housing 1.

Through the above assembling steps, the cable assembly 100 is accomplished. As the retainer 4 is smaller and simpler than the insulative housing 1, so the manufacturing cost of the retainer 4 is lower than that of the insulative housing 1. And the retainer 4 is also easier to manufacture than the insulative housing 1. It should be noted that a receiving room of the insulative housing can hold two or more stacked connectors, thus the retainer can also hold one or more stacked electrical connectors to meet the electrical connectors tightly positioned in the insulative housing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

an insulative housing, defining a first receiving room extending rearwardly from a front surface of the insulative housing; the insulative housing is defined by an upper cover and a lower cover engaged with the upper cover;

a first electrical connector received into the first receiving room;

a first cable electrically connected with the first electrical connector and extending rearwardly out of the insulative housing, and a retainer received into the first receiving room and engaged with the insulative housing, the first electrical connector held by the retainer;

a second electrical connector is received into the second receiving room of the insulative housing;

the retainer defines a bottom wall, a top wall and a side wall connected with the top and bottom wall, a receiving slot is defined by the bottom wall, the top wall and the side wall;

the side wall of the retainer defines a slot fitting with a rib formed in the first receiving room of the insulative housing;

a plurality of hollow posts extending from inner surfaces of the upper cover to be received by a plurality of cylindrical posts extending from inner surfaces of the lower cover to assure the upper and lower covers are completely connected together;

a plurality of posts extending from inner surfaces of one of the upper cover and lower cover to assure the first and second electrical connectors positioned in a right location;

the first electrical connector is a USB connector and the second electrical connector is an audio connector.

2. The cable assembly as recited in claim 1, wherein the upper cover having a plurality of latches to engage the a plurality of hooks on the lower cover.

3. The cable assembly as recited in claim 1, wherein the insulative housing defines a second receiving room arranged side by side with the first receiving room in a transversal direction.

4. The cable assembly as recited in claim 3, wherein a height of the lower cover is approximately the same as a height of the second connector.

5. The cable assembly as recited in claim 4, wherein a rear wall of the lower cover is higher than a front wall of the lower cover for holding the cables.

6. The cable assembly as recited in claim 4, wherein a second cable is electrically connected with the second and extending rearwardly out of the insulative housing.

7. The cable assembly as recited in claim 5, a rear wall of the upper cover is higher than a front wall of the upper cover for holding the cables.

8. The cable assembly as recited in claim 7, wherein a plurality of haft arc holders located in the rear wall of the upper cover to assemble with a plurality of haft arc holders located in the rear wall of the lower cover for holding the cables.

9. The cable assembly as recited in claim 7, the first electrical connector is received into the receiving slot of the retainer.

10. The cable assembly as recited in claim 9, wherein the first electrical connector defines a platform portion received into a recess formed in the bottom wall of the retainer.

11. A cable assembly, comprising:

an insulative housing defining a first receiving room and a second receiving room arranged side by side with each other in a transversal direction;

the insulative housing is defined by an upper cover and a lower cover engaged with the upper cover;

a connector module including a retainer and a first connector held by the retainer, and disposed in the first receiving room of the insulative housing;

a second connector disposed in the second receiving room of the insulative housing; and a first and second cables respectively electrically connected with the first and second connectors.

the retainer defines a bottom wall, a top wall and a side wall connected with the top and bottom wall, a receiving slot is defined by the bottom wall, the top wall and the side wall;

the side wall of the retainer defines a slot fitting with a rib formed in the first receiving room of the insulative housing;

a plurality of hollow posts extending from inner surfaces of the upper cover to be received by a plurality of cylindrical posts extending from inner surfaces of the lower cover to assure the upper and lower covers are completely connected together;

a plurality of posts extending from inner surfaces of one of the upper cover and lower cover to assure the first and second electrical connectors positioned in a right location;

the first electrical connector is a USB connector and the second electrical connector is an audio connector.

12. The cable assembly as recited in claim 11, wherein the retainer defines a receiving slot, and the first connector is received into the receiving slot.

13. The cable assembly as recited in claim 11, wherein; the upper cover having a plurality of latches to engage the a plurality of hooks on the lower cover.

14. The cable assembly as recited in claim 11, wherein the first and second cable extends out of the insulative housing through cable outlets formed on a rear surface of the insulative housing.

15. The cable assembly as recited in claim 11, wherein a rear wall of the lower cover is higher than a front wall of the lower cover for holding the cables.

16. A cable connector assembly comprising:

a housing including an upper cover and a lower cover assembled together to define first and second receiving rooms arranged in a side by side manner; said first receiving room being configured to snugly receive a first connector set therein; and said second receiving room being configured to either snugly receive a second connector set or snugly receive a third connector set with assistance of a retainer; wherein said third connector set is thinner than the second connector set under condition that said retainer compensates a thickness difference between said second connector set and said third connector set for compliance with said second receiving room; and a retainer received into the first receiving room and engaged with the insulative housing, the first electrical connector held by the retainer;

the retainer defines a bottom wall, a top wall and a side wall connected with the top and bottom wall, a receiving slot is defined by the bottom wall, the top wall and the side wall;

the side wall of the retainer defines a slot fitting with a rib formed in the first receiving room of the insulative housing;

a plurality of hollow posts extending from inner surfaces of one of the upper cover and the lower cover to be received by a plurality of cylindrical posts extending from inner surfaces of the other of the upper cover and the lower cover to assure the first and second covers are completely connected together;

a plurality of posts extending from inner surfaces of one of the upper cover and lower cover to assure the first and second or third electrical connectors positioned in a right location;

the first electrical connector is a USB connector and the second or third electrical connector is an audio connector.

17. The cable connector assembly as claimed in claim 16, wherein said second receiving room is dimensioned similar to the first receiving room in height.

18. The cable connector assembly as claimed in claim 16, wherein the second connector set is dimensioned similar to the third connector set.

19. The cable connector assembly as claimed in 18, wherein said second connector set and said third connector set belong to a same type connector except that the second connector is of a dual-port type while the third connector set is of a single port type.

20. The cable connector assembly as claimed in claim 18, wherein said retainer and said housing are overlapped with each other in a transverse direction so that the retainer is only to compensate said thickness difference along a vertical direction in the second receiving room without affecting in a transverse direction or a front-to-back direction both of which are not only perpendicular to said vertical direction also each other.

* * * * *